US006786198B1

(12) United States Patent
Miranda et al.

(10) Patent No.: US 6,786,198 B1
(45) Date of Patent: Sep. 7, 2004

(54) COLD START COMPENSATION FOR P-I-D ENGINE GOVERNOR

(75) Inventors: Victor H. Miranda, Wheaton, IL (US); James T. Beaucaire, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/697,435

(22) Filed: Oct. 29, 2003

(51) Int. Cl.[7] ..... F02D 31/00
(52) U.S. Cl. ..... 123/352; 123/362
(58) Field of Search ..... 123/352, 350, 123/349, 362

(56) References Cited

U.S. PATENT DOCUMENTS 5,651,341 A * 7/1997 Harada et al. ..... 123/339.2
6,425,370 B1 7/2002 Kramer

* cited by examiner

*Primary Examiner*—Bibhu Mohanty
(74) *Attorney, Agent, or Firm*—Dennis Kelly Sullivan; Susan L. Lukasik; Jeffrey P. Caifa

(57) ABSTRACT

An electronic engine control system includes a P-I-D governor (10) that provides a data output having a proportional component (P), an integral component (I), and a derivative component (D), each of which is derived from closed-loop processing of engine speed error data (NERR). A Cold Adder function (16) provides a further component to the data output, that further component having a data value that is based on engine temperature (EOT) and on elapsed engine running time since the engine was last started.

12 Claims, 2 Drawing Sheets

COLD START COMPENSATION FOR P-I-D ENGINE GOVERNOR

FIELD OF THE INVENTION

This invention relates generally to motor vehicle internal combustion engines having electronic governors. More specifically, the invention relates to engines, systems, and methods for compensating a P-I-D (proportional-integral-derivative) engine governor as the engine is warming up to improve engine speed stability, such as when the engine is idling.

BACKGROUND OF THE INVENTION

A known electronic engine control system in a motor vehicle comprises a processor-based system that processes data from various sources to develop control data for controlling certain functions of the engine. A processor-based control system processes certain data useful in setting a data value for engine fueling representing the quantity of fuel that is to be injected by fuels injectors into engine cylinders where the injected fuel is combusted to run the engine and power the vehicle.

An electronic governor can be incorporated into an electronic engine control system to provide engine governing. The governor develops data represented governed fueling, and that governed fueling data is used to govern the quantity of fuel injected by the fuel injectors for the purpose of limiting engine speed at times when the engine might otherwise seek to run at a higher speed.

An electronic engine governor operates to govern engine fueling according to the particular governor strategy incorporated into the electronic engine control system. Commonly owned U.S. Pat. No. 6,425,370 describes a diesel engine load governor using engine speed setpoint.

A known engine control system that is present in certain engines manufactured by International Truck and Engine Corporation is premised on isochronous speed regulation and utilizes engine speed as a setpoint that is subsequently processed with additional data for developing a proper fueling command to operate the engine at the corresponding speed. The processor contains programmed data correlating engine speed setpoint data with combinations of accelerator pedal position data and engine load data and processes accelerator pedal position data and engine load data in accordance with that programmed data to develop the engine speed setpoint data.

The driver of a motor vehicle that is powered by a diesel engine typically uses an accelerator pedal to accelerate the engine, and the accelerator pedal position data comes from an accelerator position sensor (APS) operated by the accelerator pedal. Actual engine speed is an input to the governor P-I-D, and engine speed error, meaning the difference between actual engine speed and the engine speed setpoint, is another input to the governor P-I-D. The governor P-I-D processes the inputs to develop output data representing a governed mass fuel input to the engine. The engine control system subsequently develops a corresponding pulsewidth signal for operating the engine fuel injectors.

As the engine is warming up, the effect of the governor on engine fueling may at times cause variations in engine idle speed that some may consider undesirably excessive. The driver of a motor vehicle powered by such an engine may consider such variations objectionable, or perhaps even perceive them as a problem with the engine. Although the proportional-integral-derivative (P-I-D) function is typically calibrated for general governing with the engine fully warmed, such a strategy can aid in controlling governor-induced speed variations during warm-up, such as when the engine is idling.

The P-I-D governor function is part of a closed-loop strategy based on engine speed error and control gains. The governed fueling data developed by P-I-D processing comprises a proportional component that processes the engine speed error input, an integral component that processes the engine speed error input, and a derivative component that processes the engine speed error input. The calibration of the governor allows a different control gain to be used in the development of each of the three components. The three components are summed together by a summing function to create the governed fuel data.

It is believed that further reductions in governor-induced speed variations, especially during warm-up of a cold diesel engine would be desirable. It is toward that objective that the present invention is directed.

SUMMARY OF THE INVENTION

Accordingly one generic aspect of the invention comprises an internal combustion engine that comprises an electronic engine control system and a fueling system governed by an electronic P-I-D governor in the electronic engine control system. The P-I-D governor provides a data output having a proportional component, an integral component, and a derivative component, each of which is derived from closed-loop processing of engine speed error data. The P-I-D governor further comprises a function that provides a further component to the data output, that further component comprising a data value that is based on engine temperature and on elapsed engine running time since the engine was last started.

Still other generic aspects relate to an engine control system having a governor as just described and the method that is performed.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
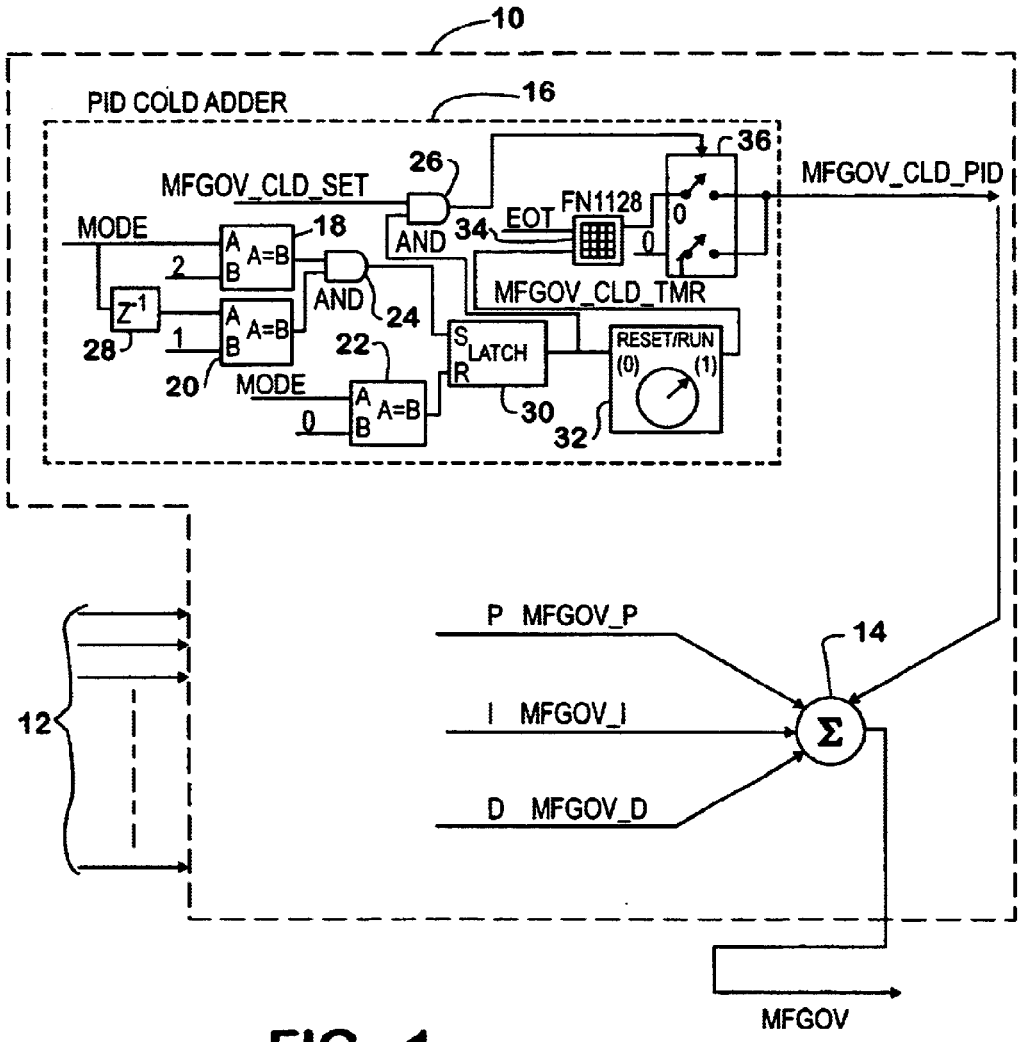
FIG. 1 is a software strategy diagram that discloses the inventive principles in a portion of an exemplary processor-based engine control system.

FIG. 1 discloses that portion of a diesel engine electronic engine control system that comprises a P-I-D governor 10 for performing P-I-D calculations, such as those described above in the patented system. A number of data inputs to P-I-D governor 10 are collectively represented by the reference numeral 12. One of those inputs is engine speed error NERR. P-I-D governor 10 applies a proportional control gain to NERR to develop a data value $MFGOV_{13}$ P representing a proportional component for governed fueling data. P-I-D governor 10 also applies an integral control gain to an integral of NERR to develop a data value MFGOV_I representing an integral component for governed fueling data. P-I-D governor 10 also applies an integral control gain to a derivative of NERR to develop a data value MFGOV_D representing a derivative component for governed fueling data.

Instead of relying solely on the three components proportional, integral, and derivative to form the governed fueling data output MFGOV of P-I-D governor 10 at a summing function 14 that algebraically sums them, the present invention includes a fourth component for MFGOV that is algebraically summed with the first three at summing function 14. That fourth component is identified as MFGOV_CLD_PID and is provided by a P-I-D Cold Adder function 16.

P-I-D Cold Adder function 16 comprises: three comparison functions 18, 20, 22; two AND logic functions 24, 26; a store 28; a latch function 30; a timer function 32; a map function 34; and a switch function 36.

There are three inputs to P-I-D Cold Adder function 16 designated as: MODE; MFGOV_CLD_SET; and EOT. MODE is a data value that is present in the engine control system to identify the engine operating condition. When MODE has a data value "0", it identifies a "no start" condition. When MODE has a data value "1", it identifies an "engine cranking" condition. When MODE has a data value "2", it identifies an "engine running" condition.

The data value for MODE is an input to both store 28 and one input of comparison function 18. The output of store 28 is an input to one input of comparison function 20. A "2" is the input to the second input of comparison function 18. A "1" is the input to the second input of comparison function 20. The outputs of comparison functions 18 and 20 are inputs to AND logic function 24.

When the engine is being started, the driver operates a switch, commonly referred to as an ignition switch. The switch is initially off, but when operated causes the cranking motor to crank the engine. When the engine begins to run under its own power, the driver releases the switch, which then automatically returns to a position that terminates cranking while allowing the engine to keep running. As the ignition switch initially operates to crank the engine, the data value for MODE changes from "0" (representing OFF) to "1" representing engine cranking.

Because the strategy executes at a certain execution rate, the output of store 28 does not immediately change with the change in MODE. Rather, it changes at the next iteration of the strategy, and it is at that time that the data value stored in store 28 changes from a "0" to a "1".

Because both data inputs to comparison function 20 are now "1" and because function 20 is configured to indicate equality of the two inputs to it, function 20 now provides a "1" to AND logic function 24. However, the other input to AND logic function 24 remains a "0" during cranking.

When cranking terminates and the engine is running, MODE changes from "1" to "2" representing engine running. Because the output of store 28 cannot change until the next iteration of the strategy, the output of the store remains a "1", causing a "1" to be maintained at the output of AND logic function 20. However, the change in MODE from "1" to "2" has immediate effect on comparison function 18.

Because function 18 is configured to indicate equality of the two inputs to it, function 18 immediately provides a "1" to AND logic function 24. With both inputs to AND logic function 24 being "1", the output of function 24 changes from "0" to "1".

Hence, elements 18, 20, 24, 28 of P-I-D Cold Adder function 16 coact to indicate that the engine has been cranked and is running under its own power.

Latch function 30 has a set input S and a reset input R. AND logic function 24 serves to set latch function 30 while comparison function 22 serves to reset function 30.

MODE is one input to comparison function 22, which is configured to indicate equality of the two inputs to it. With the data value for MODE either a "1" or a "2", function 22 is providing a "0" output to latch function 30 allowing the latch function to be set.

Consequently, upon termination of engine cranking with the engine running under its own power, latch function 30 is set. The setting of latch function 30 does two things: changes one input to AND logic function 26 from a "0" to a "1"; and starts timer function 32. This represents one way for starting timer function 32 so that a reasonably accurate measure of elapsed engine running time since the engine was last started can be developed for P-I-D Cold Adder function 16.

MFGOV_CLD_SET is a parameter that enables and unenables P-I-D I-Cold Adder function 16. The data value for MFGOV_CLD_SET must be a "1" for enabling P-I-D Cold Adder function 16; otherwise the function is not enabled. If the function is not enabled, the setting of latch function 30 has no effect. However if the function is enabled, the setting of latch function 30 causes the output of AND logic function to change from "0" to "1", and that will operate switch function 36 from ON to OFF.

With switch function 36 ON, the data value for MFGOV_CLD_PID is "0". Hence, it makes no contribution to MFGOV. With switch function 36 OFF, the data value for MFGOV_CLD_PID is determined by map function 34.

Map function 34 contains data values for MFGOV_CLD_PID, each of which correlates with data values a respective pair of data values for MFGOV_CLD_TMR and EOT. EOT is a parameter that represents engine temperature. Measurement of engine oil temperature is a commonly used measurement of engine temperature. Each data value for EOT represents a corresponding fractional span of a range of engine oil temperature while each data value for MFGOV_CLD_TMR represents a corresponding fractional span of a range of running time for timing function 32. For any given combination of EOT and timing function running time, EOT will fall within one of its fractional spans in map function 34, and timing function running time will fall within one of its fractional spans, causing the data value for MFGOV_CLD_TMR correlated with the two respective fractional spans to be supplied as the output of map function 34. With switch function 36 OFF, the output of map function 34 becomes the data value for MFGOV_CLD_PID.

The viscosity of cold engine motor oil affects P-I-D governor performance. The effect of cold engine motor oil is evidenced by fluctuations in engine idle speed as the engine is warming up. By including P-I-D Cold Adder function 16 as part of P-I-D governor 10, the proportional, integral, and derivative portions can be optimized for fully warmed engine running while P-I-D Cold Adder function 16 ameliorates aberrations in desired engine running due to viscosity of engine motor oil before the engine has fully warmed up.

Data values for map function 34 are determined during engine calibration procedures for the particular engine model involved. The values may be determined in any suitably appropriate way or ways, for example by calculation and/or by actual running.

The use of timing function 32 provides for the influence of map function 34 on P-I-D governor 10 to gradually fade away as the engine approaches fully warm running. In that way P-I-D governor 10 experiences a seamless transition to P-I-D control that is free of the effect of Cold Adder function 16 once the engine has fully warmed up. The use of both engine oil temperature and time addresses situations where an engine may be warmed up in different ways, some of which result in faster warm-ups and others of which result in slower warm-ups. It also takes into account those situations where the engine is shut down before being fully warmed up and then restarted.

After the engine has been shut down, MODE assumes a data value "0", causing comparison function 22 to reset latch function 30.

Figure 2:
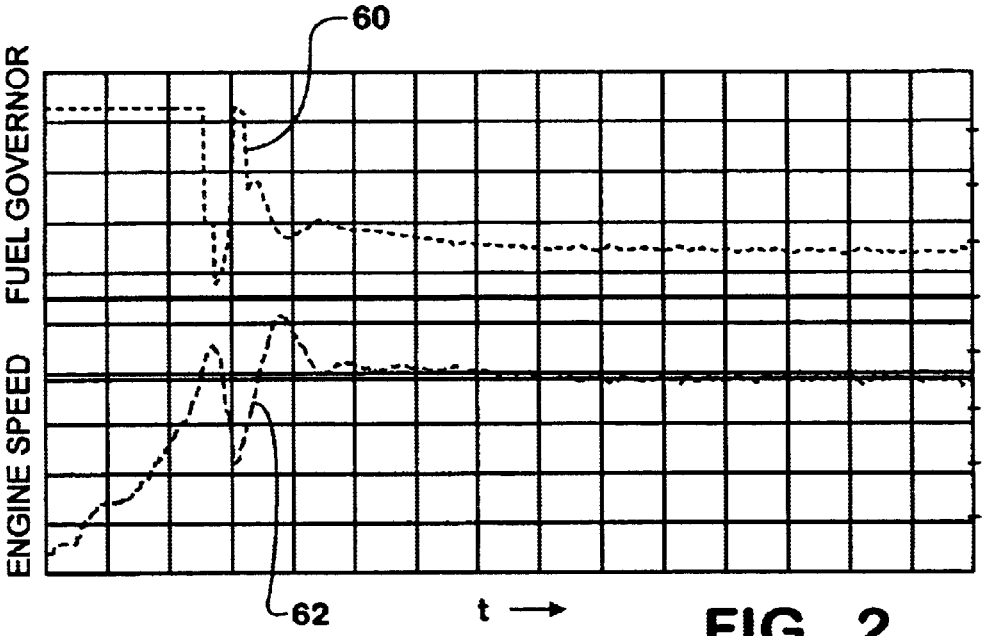
FIG. 2 is a graph plot representing certain aspects of engine operation without the invention being enabled in an electronic engine control system.
Figure 3:
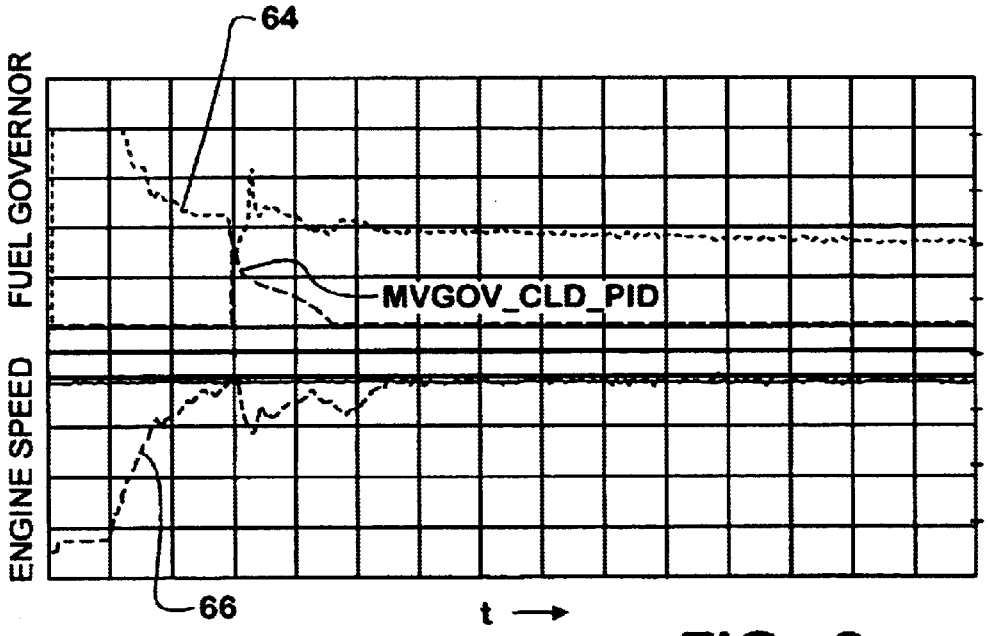
FIG. 3 is a graph plot representing the same aspects of engine operation with the invention being enabled in the electronic engine control system.

FIG. 2 shows a fuel governor trace 60 and an engine speed trace 62 upon cold starting of an engine without Cold Adder function 16 being enabled by MFGOV_CLD_SET. By comparison, FIG. 3 shows a fuel governor trace 64 and an engine speed trace 66 upon cold starting of an engine with Cold Adder function 16 being enabled by MFGOV_CLD_SET. Trace 62 discloses some overshoot and subsequent oscillation before idle speed stabilizes. Trace 66 is somewhat more damped with insignificant overshoot and smaller peak-to-peak excursions in the ensuing oscillation before idle speed stabilization. It is believed that this proves the effectiveness of the invention in accomplishing the intended objective.

While a presently preferred embodiment of the invention has been illustrated and described, it should be appreciated that principles of the invention apply to all embodiments falling within the scope of the following claims.

What is claimed is:

1. An internal combustion engine comprising:

an electronic engine control system; and a fueling system governed by an electronic P-I-D governor in the electronic engine control system;

wherein the P-I-D governor provides a data output having a proportional component, an integral component, and a derivative component, each of which is derived from closed-loop processing of engine speed error data; and the P-I-D governor further comprises a function that provides a further component to the data output, that further component comprising a data value that is based on engine temperature and on elapsed engine running time since the engine was last started.

2. An engine as set forth in claim 1 wherein the function that provides the further component to the data output of the P-I-D governor comprises a map containing data values each of which is correlated with data values of temperature and time.

3. An engine as set forth in claim 2 wherein the data values for time are derived from a timer function that begins timing upon the engine control system changing from an engine cranking mode to an engine running mode.

4. An engine as set forth in claim 1 including a switch function for selectively allowing and disallowing the further component to the data output.

5. An electronic engine control system for an internal combustion engine that has a fueling system for fueling the engine, the control system comprising:

an electronic P-I-D governor that provides a data output having a proportional component, an integral component, and a derivative component, each of which is derived from closed-loop processing of engine speed error data; and a function that provides a further component to the data output of the P-I-D governor, that further component comprising a data value that is based on engine temperature and on elapsed engine running time since the engine was last started.

6. An engine control system as set forth in claim 5 wherein the function that provides the further component to the data output of the P-I-D governor comprises a map containing data values each of which is correlated with data values of temperature and time.

7. An engine control system as set forth in claim 6 wherein the data values for time are derived from a timer function that begins timing upon the engine control system changing from an engine cranking mode to an engine running mode.

8. An engine control system as set forth in claim 5 including a switch function for selectively allowing and disallowing the further component to the data output.

9. A method of governing an internal combustion engine that has an electronic engine control system and a fueling system for fueling the engine under control of the engine control system, the method comprising:

closed-loop processing engine speed error data in an electronic P-I-D governor of the engine control system to provide a data output having a first component that is a proportional function of the error data, a second component that is an integral function of the error data, and a third component that is a derivative function of the error data; and processing engine temperature data and engine running time data corresponding to elapsed engine running time since the engine was last started to provide a further component to the data output of the P-I-D governor.

10. A method as set forth in claim 9 wherein the step of processing engine temperature data and engine running time data corresponding to elapsed engine running time since the engine was last started comprises processing the engine temperature data and the engine running time data according to a map containing data values each of which is correlated with data values of temperature and time.

11. A method as set forth in claim 10 including the step of deriving the data values for engine running time by starting a timer function upon the engine control system changing from an engine cranking mode to an engine running mode.

12. A method as set forth in claim 9 including the step of selectively allowing and disallowing the further component to the data output according to a data value that selectively enables and unenables the further component to the data output of the P-I-D governor.

* * * * *